United States Patent [19]

Spooner et al.

[11] 4,015,494

[45] Apr. 5, 1977

[54] COLD CUT SLICING SYSTEM

[75] Inventors: Robert J. Spooner; Oscar W. Dillon, both of Essex, Conn.

[73] Assignee: Cashin Systems Corporation, Williston Park, N.Y.

[22] Filed: June 24, 1975

[21] Appl. No.: 589,831

[52] U.S. Cl. ..... 83/76; 83/77; 83/91; 83/403.1; 83/409; 83/719; 83/734

[51] Int. Cl.[2] ..... B26D 5/20; B26D 4/50

[58] Field of Search ..... 279/3; 83/76, 77, 91, 83/719, 727, 734, 298, 367, 403.1, 409, 409.1, 437

[56] References Cited

UNITED STATES PATENTS

| | | | |
|---|---|---|---|
| 3,802,306 | 4/1974 | Brown | 83/76 X |
| 3,821,913 | 7/1974 | Bajcar et al. | 83/77 X |
| 3,880,295 | 4/1975 | Wyslotsky | 83/409 X |
| 3,894,457 | 7/1975 | Miller et al. | 83/77 X |

FOREIGN PATENTS OR APPLICATIONS

| | | | |
|---|---|---|---|
| 1,287,965 | 1/1969 | Germany | 83/719 |

*Primary Examiner*—Willie G. Abercrombie
*Attorney, Agent, or Firm*—Kane, Dalsimer, Kane, Sullivan and Kurucz

[57] ABSTRACT

A high speed automatic cold cut feeding, slicing and weighing system which is completely electrical in operation and control to provide cleanliness in operation, high speed, simplified control of all functions of the machine, and extreme accuracy in weight during high speed operation. In the system the rate of feed of the meat feeder is synchronized with the speed of rotation of the slicing blade shaft thereby automatically adjusting the speed of the slicing knife to maintain constant scaling rate.

2 Claims, 7 Drawing Figures

COLD CUT SLICING SYSTEM

BACKGROUND OF THE INVENTION

The invention relates to improvements in apparatus for slicing meat products and more particularly to an all electric slicing and weighing system which operates automatically and at high speed and provides extreme weighing accuracy when the system is operated at top speed. Such system permits changes in stack weight easily and quickly without stopping production or loss of accuracy. When the slice count and stack weight has been selected the system automatically adjusts the speed of the slicing knife to maintain constant scaling rate.

Most of the existing machines and systems employ hydraulics for operation and thus have certain disadvantages or limitations. The system of the present invention is an improvement over such existing machines and systems.

Slicing apparatus of the type described herein is being marketed by Cashin Systems Corp., Williston Park. N.Y. and is disclosed in commonly assigned U.S. Pat. Nos. 2,903,032 granted Sept. 8, 1959; 2,969,099 granted Jan. 23, 1961; 3,027,924 granted Apr. 3, 1962; 3,099,304 granted July 30, 1963; 3,200,864 granted Aug. 17, 1965; and 3,204,676 granted Sept. 7, 1965.

SUMMARY OF THE INVENTION

It is an object of the invention to provide an improved cold cut slicing and weighing system which is completely electrical in operation and control.

It is a further object to provide a cold cut slicing and weighing system in which the rate of feed of the meat feeder is synchronized with the speed or rotation of the shaft of the slicing blade.

It is a further object to provide a high speed automatic cold cut slicing and weighing system which is completely electrical in operation and control and which is adapted for greater cleanliness in operation, simplified control of all functions of the machine, and extreme accuracy in weight during high speed operation.

It is a further object to provide a machine of the type described herein with an improved hold down device for the meat being fed to the slicer.

It is a further object to provide a machine of the type described herein which offers trouble free maximum production, less waste of meat product, simplified operator controls, and super accurate automatic weighing when the machine is operated at its top speed.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
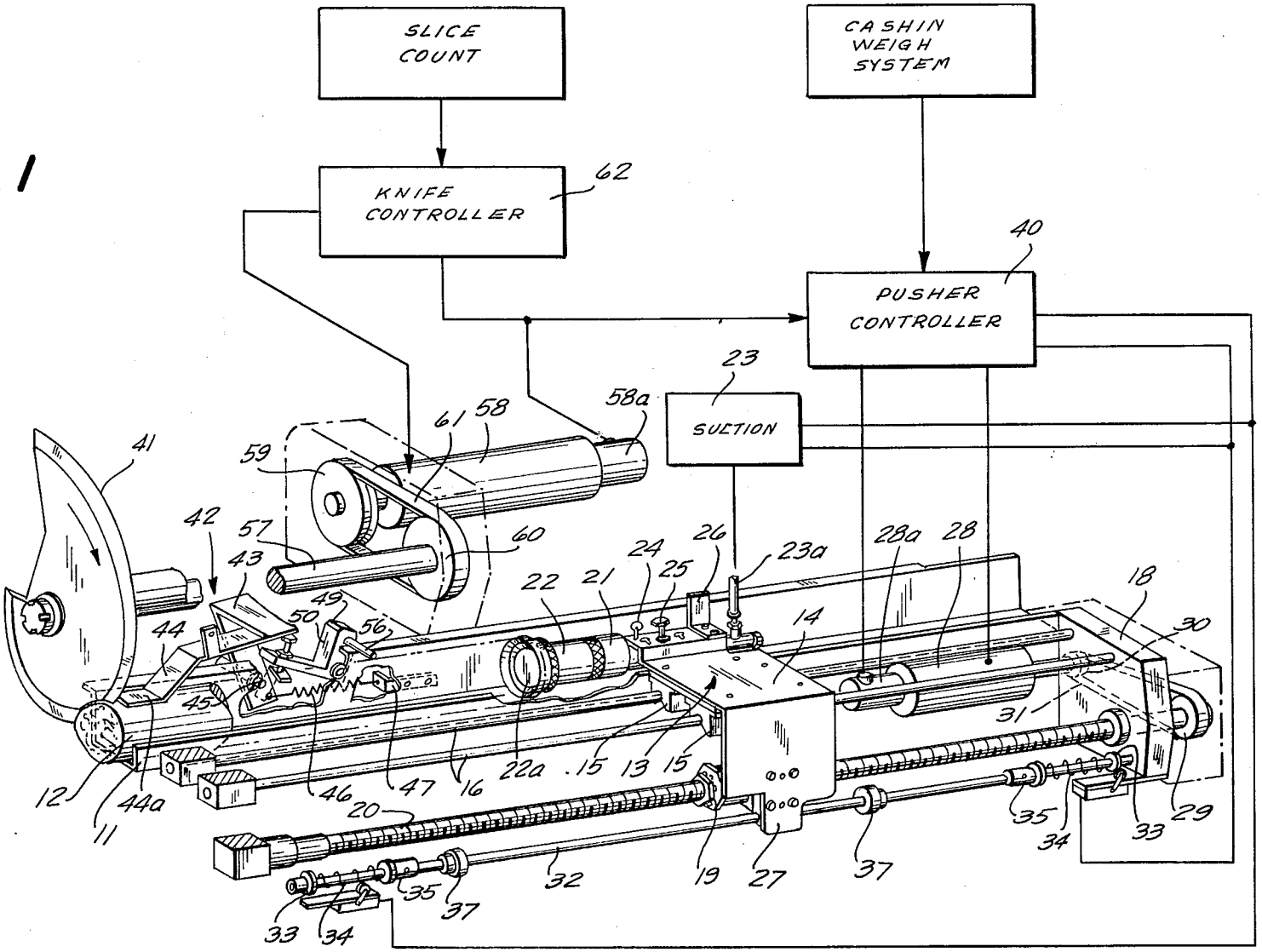
FIG. 1 is a perspective side view of the slicing machine of the present invention with certain parts removed and broken away for purposes of clarity of illustration.
Figure 2:
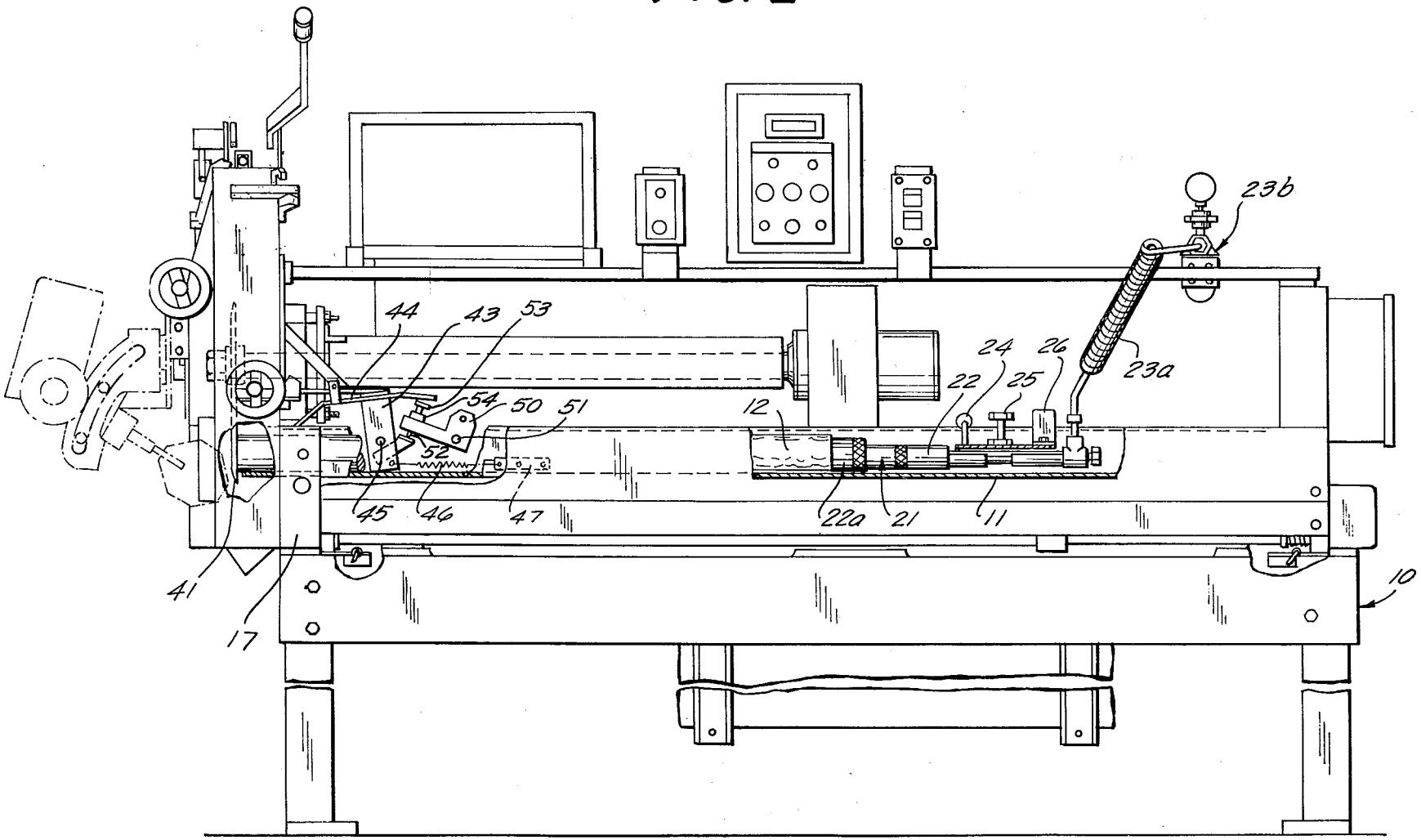
FIG. 2 is a side elevational view of the slicing machine of FIG. 1.
Figure 3:
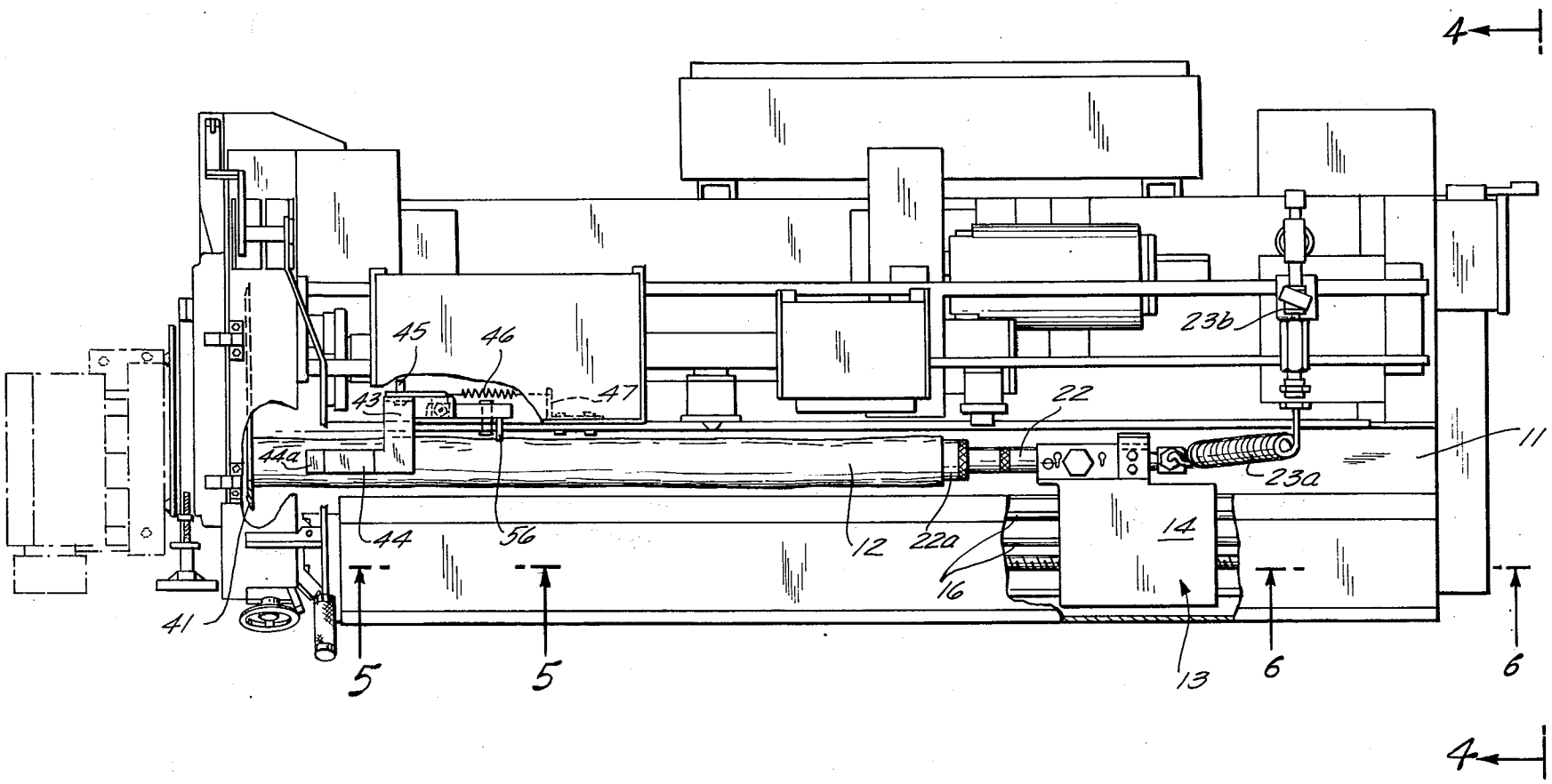
FIG. 3 is a top plan view of the machine.

Referring to the drawings, there is shown in FIGS. 1, 2 and 3 a supporting table 10 with a channel or bed 11 running the length of the machine to receive the loaf of meat 12 to be sliced. Within such channel a spring loaded fence or other means can be used to position the loaf within the channel, but such fence does not constitute a part of the present invention.

Figure 7:
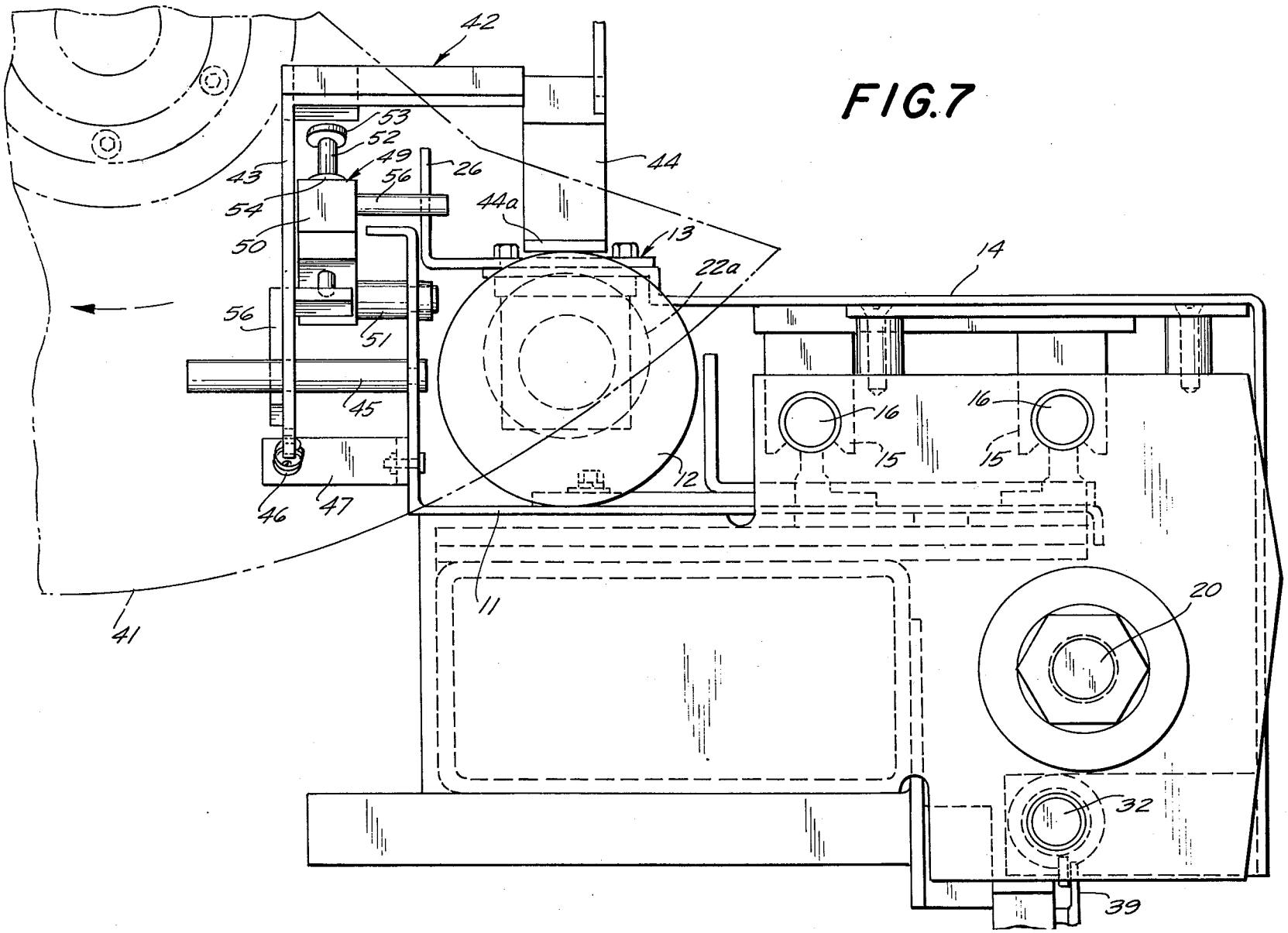
FIG. 7 is a front elevational view along the line 7—7 of FIG. 5.

There is a meat gripper carriage 13 which comprises an L-shaped plate 14 beneath which are a pair of grooved supports 15 which ride on a pair of shafts 16 running the length of the machine (FIG. 7). Such shafts 16 are supported between blocks 17 and 18 at each end of the table 10. The supports 15 permit the carriage 13 to move parallel to the meat channel 11 for the full length of the machine. Affixed to the inner face of the short side of the L of the carriage 13 is a threaded member 19 which engages a drive screw 20 also rotatably mounted at each end between the blocks 17 and 18. The rotation of the screw 20 will move the carriage 13 backward and forward along such screw 20 and the shafts 16. Affixed to the end of the long side of the L of the carriage 13 is a meat gripper assembly 21, which comprises a tube 22 with a suction cup **22*a* at the end of the tube 22 positioned to grip the back end of the meat loaf 12 in the channel 11 (FIG. 1). Such tube 22 is connected to a source of vacuum 23, through tube 23*a* and shut off and adjustment valve 23*b*, to provide suction through the tube and cup to grip the end of the meat. The tube 22 is provided with two mounting screws 24 and 25 to vary the position of the tube with respect to the carriage 13. Also affixed to the end of the long side of the L of the carriage 13 is a lifter plate 26 which is positioned to move along the path of the channel 11 to actuate the meat hold down device to be described hereinafter. Affixed to the end of the short side of the L of the carriage 13 is a switch plate 27** the purpose of which will be described hereinafter.

Figure 4:
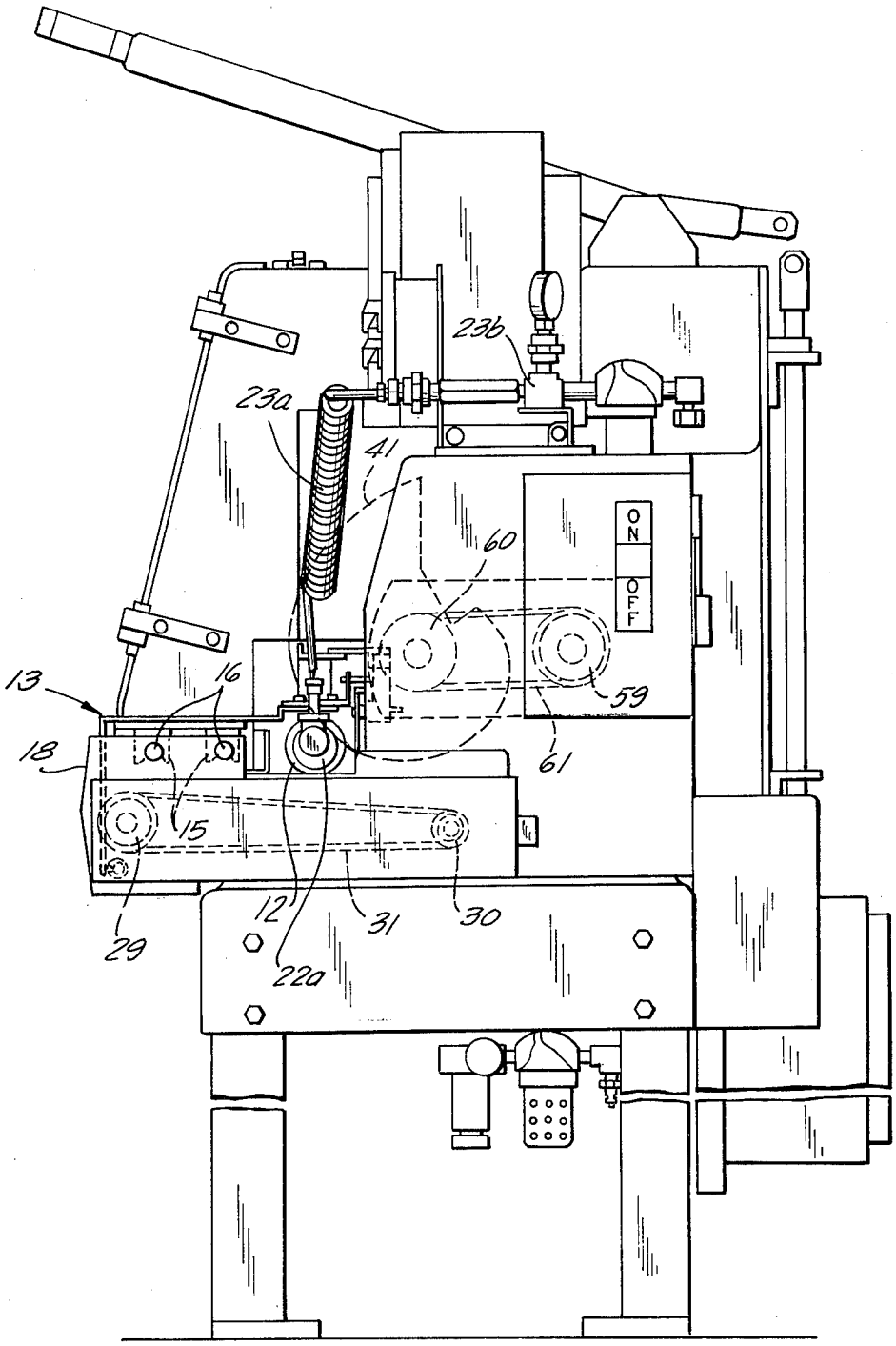
FIG. 4 is a rear elevational view along the line 4–4 of FIG. 3.

The screw 20 for moving the meat gripper carriage 13 is rotated by a feed motor 28 through pulleys 29 and 30 and belt 31. The pulleys 29 and 30 are mounted respectively on the motor shaft and screw 20 which pass through the block 18 (FIG. 4).

Figure 5:
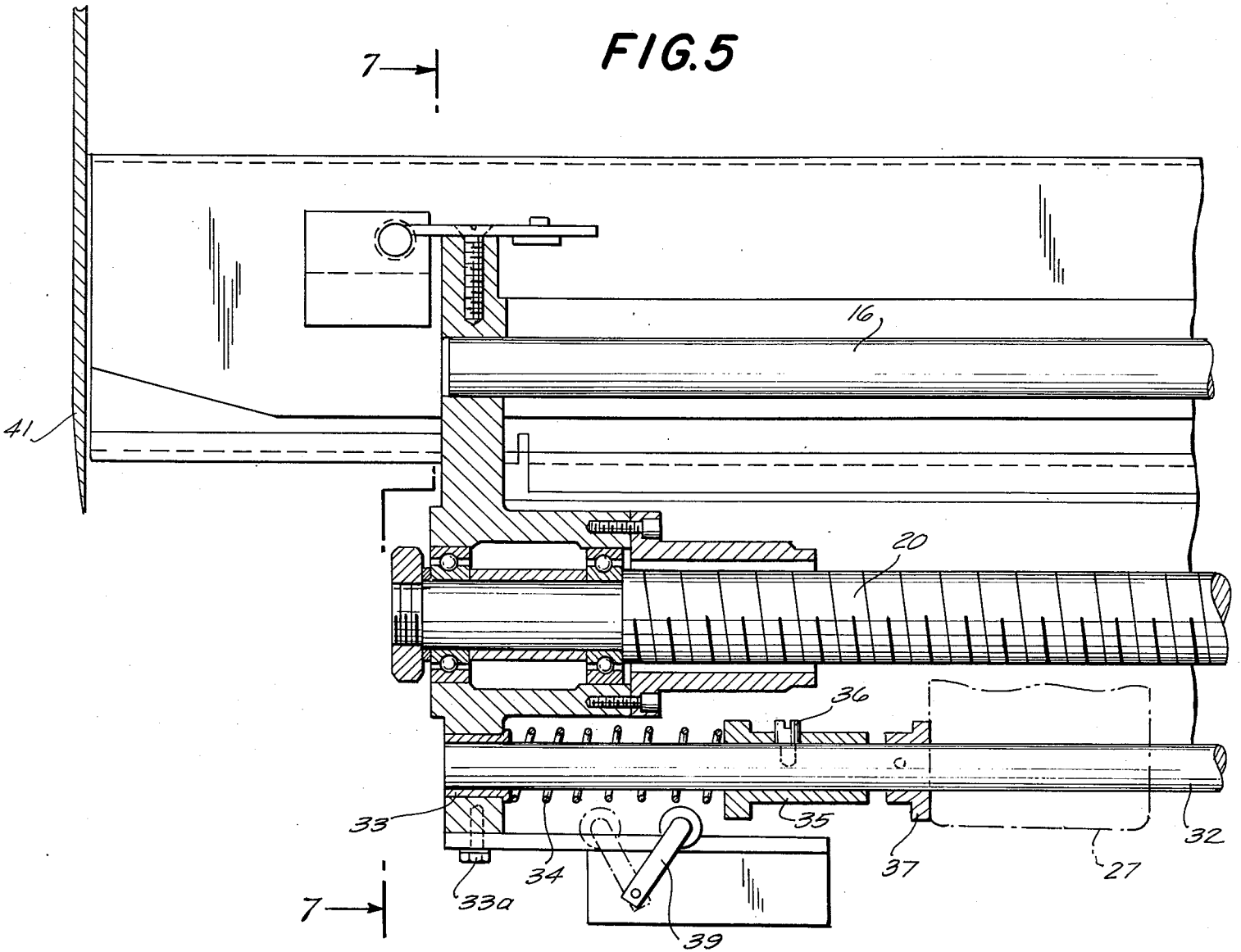
FIG. 5 is a side elevational view of the front end of the machine along the line 5—5 of FIG. 3.
Figure 6:
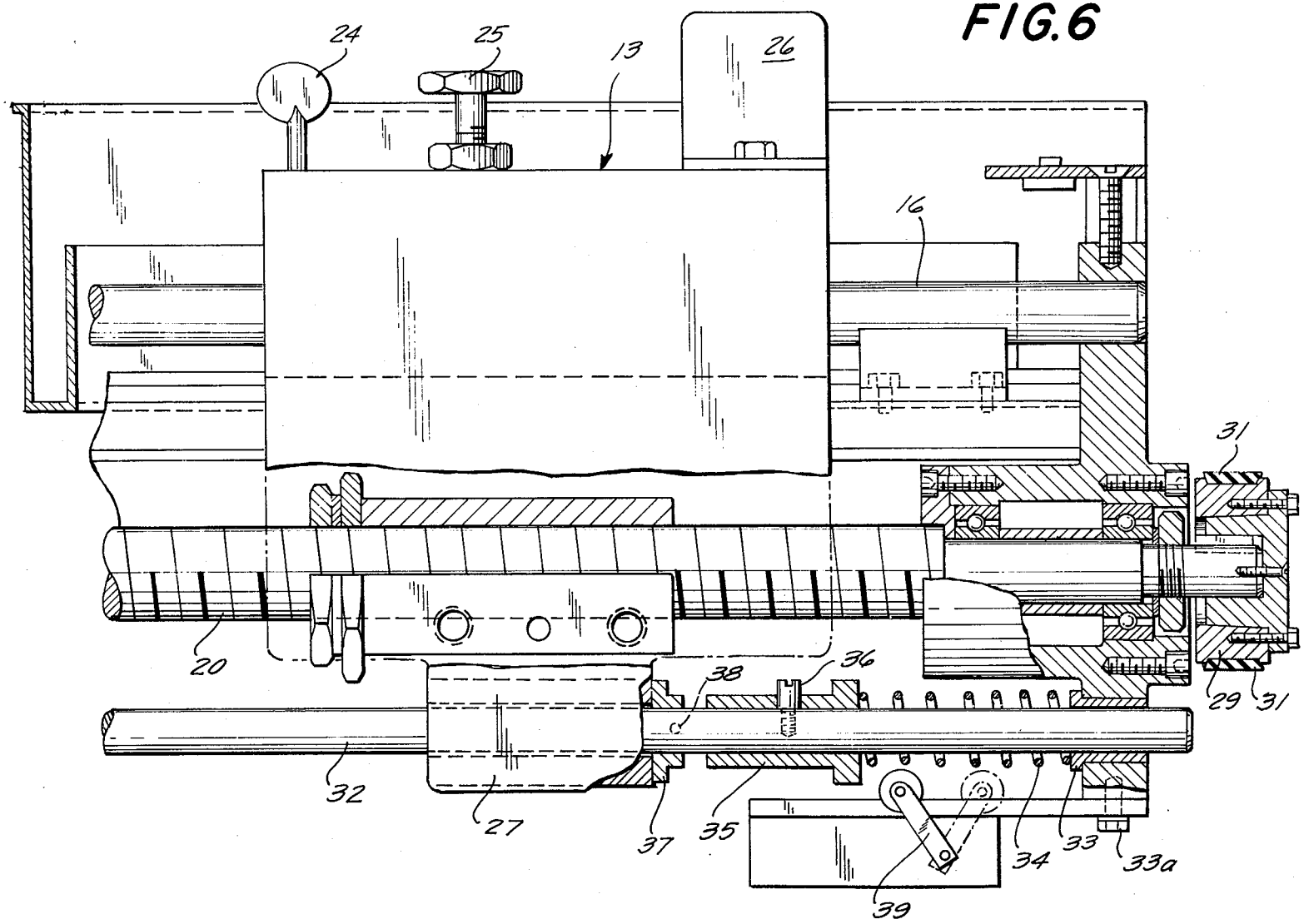
FIG. 6 is a side elevational view of the rear end of the machine along the line 6—6 of FIG. 3.

Mounted between the blocks 17 and 18 is an actuator rod 32 which is spring loaded at each end (FIGS. 5 and 6). Such rod 32 is slidably mounted at each end in bushings 33 held in the blocks 17 and 18 by set screws **33*a*. The rod 32 passes through a spring 34 at each end. Each spring bears against the bushing 33 and is retained in position on the rod by an actuator collar 35 secured to the rod by a set screw 36. Adjustably mounted on the rod 32 on each side of the switch plate 27 are pusher collars 37. Such pusher collars 37 can be adjusted to any position on the rod and secured to the rod by set screws 38. Positioned at each end of the rod 32 and adjacent the blocks 17 and 18 are limit switches 39 which are connected to the suction 23 and also to the pusher controller 40. When the meat gripper carriage 13 moves toward the knife blade 41 during the slicing operation it reaches a point where the loaf of meat has been almost completely sliced. At that time the switch plate 27 on the carriage strikes the forward pusher collar 37 on the rod 32 moving the rod 32 forward. The forward movement of the rod 32 causes the forward actuator collar 35 to contract the forward spring 34 and press against the forward limit switch 39, which reverses the feed motor 28. The carriage moves backward away from the knife blade until the switch plate 27 strikes the rear pusher collar 37, whereby the rod 32 is moved backward which causes the actuator collar 35 to contract the rear spring 34 and press against the rear limit switch 39. The tripping of the rear limit switch 39 releases the suction on suction cup 22***a* and applies a blast of air from the suction cup 22*a* to release the butt of meat from the cup. The machine is now ready to receive the next loaf for slicing. It will be understood that the forward spring 34, forward actuator collar 35 and the forward pusher collar 37 on the rod could be eliminated, in which case the switch plate 27 will make direct contact with the forward limit switch 39 to reverse the feed motor 28.

To hold down the forward end of the loaf and prevent rotation of the loaf as it is being fed toward the knife blade a meat hold down device 42 is affixed to the side of the channel 11 (FIGS. 1, 2, 3 and 7). Such hold down device 42 comprises an L-shaped arm 43 to which is affixed a meat hold down plate 44 with a flat end 44*a* positioned next to the knife blade to contact the center of the loaf as it moves down the channel. The L-shaped arm 43 is rotatably mounted on a bearing-bolt 45 inserted into the side of the channel 11. The arm 43 is spring loaded by means of a spring 46 attached at one end to the bar and at the other end to a bracket 48 secured to the side of the channel 11. In its normal position the hold down plate 44 applies pressure to the top of the loaf of meat in the channel. There is also a lifting device 49 which serves to raise the meat hold down plate 44 when the slicing operation is virtually completed and only the butt of the loaf remains. The lifting device 49 comprises an L-shaped member 50 rotatably mounted on a bearing-bolt 51 inserted into the side of the channel 11. Threaded into the long side of the member 50 is an adjustable bearing screw 52 with a knob 53 and a locking nut 54. The lifting device is positioned for the bearing screw to rest on an L-shaped plate 55 projecting from and affixed to the side of the arm 43. Projecting from the short side of the member 50 is a rod 56 positioned to be contacted by the lifter plate 26 projecting from the carriage 13 as the carriage moves along the channel 11. When the meat loaf is almost completely sliced and only a butt end remains, the lifter plate 26 hits the rod 56 which causes the long side of the member 50 to move downwardly and the screw 52 to apply pressure against the plate 55 on the arm 43. This rotates the arm 43 and raises the hold down plate 44 from its contact with the loaf of meat thus permitting the carriage with the butt end of the loaf to move backward.

The slicing portion of the machine is conventional and comprises the slicing blade 41 mounted on a shaft 57 driven by a knife motor 58 through pulleys 59 and 60 and belt 61. The blade, which is rotary and in the form of an eccentric or involute shape, revolves at relatively high speed (FIG. 1). The rotating involute shape presents an advancing cutting edge for slicing the meat product. The blade is preferably dished to allow clearance for the advancing meat during the slicing cycle.

The slices of meat are deposited onto a stacker (FIGS. 2 and 3) which receives a predetermined number of slices in a stack and then deposits it onto a conveyor. Such stacker is associated with a weighing means so that each stack can be weighed or the slices can be weighed as they are stacked. The type of the stacker and weighing means form no part of the present invention, except that the weight of the stack is fed into the pusher controller which controls the speed of the meat feed to maintain the proper weight for the desired count and slice thickness as explained hereinafter. It may be pointed out that, after the high speed electrical stacker was developed, it became logical to make the whole machine electrical. The machine and system of the present invention accomplish that and provide the advantages only possible with an all electrical machine.

Some of the figures show the knife housing which serves to protect the operator and also prevent particles of sliced product from being thrown outwardly by centrifugal force. Such housing likewise does not form any part of the present invention.

The speed of the feed motor 38 determines the slice thickness (feed per revolution of the knife) for the desired slice count per minute and weight in each stack of slices. Such speed, determined for the desired weight, count and slice thickness by the "Cashin Weigh System" disclosed in the Cashin patents listed above, is initially fed into the pusher controller 40 (FIG. 1). If the weight of a stack of slices deposited on the stacker varies from the initial adjustment the controller will automatically vary the feed for an adjusted or corrected thickness. Thus the speed of the pusher controller is set for a speed which takes into consideration the meat diameter, thickness, etc. In this manner the speed of the feed of the loaf into the slicing blade by the feeder is automatically regulated to change slice thickness and thereby maintain the weight of the stacked slices within desired limits.

The slice count is fed into the knife controller 62 to establish the speed of the knife motor 58 and the knife speed to give the desired number of stacks per minute.

Both the feed motor 28 and the knife motor 58 are provided with tachometers, the tachometer for the feed motor being designated 28*a* and that for the knife motor as 58*a*. An important and novel feature of the present invention is the feed back weight correction coupling 63 between the knife controller 62 and knife tachometer 58*a* and the pusher controller 40 and feed tachometer 28*a*. By this coupling the knife speed is automatically introduced into the pusher controller. Thus if there is any change in the running speed of the knife due to variables such as load, voltage, etc. the coupling brings about a change in the rate of feed of the meat to the knife. This comes about by comparing the voltage of the tachometer of the knife motor to maintain its relation with the tachometer of the feed motor. Independent of speed the weight correction system feeds back corrective signals based upon the weighing system to maintain extreme accuracy even when the system is operated at its top speed. It will thus be seen that such feature weighs every stack of slices and automatically perfects the weight of the next stack being sliced. The result is that there are no underweights and a high percent (92%) of the stacks are passed with an average overweight of one-eighth ounce.

Briefly summarizing the operation, the weight, slice count and slice thickness are predetermined and the knife controller and pusher controller are set. This initially sets the knife speed and pusher speed. The loaf of meat is inserted into the channel and the suction cup is attached to the back end of the loaf. When the preceding loaf had been sliced the meat gripper carriage with the suction cup had been retracted to its rear position, which position has been determined by the position of the rear actuator collar on the actuator rod which tripped the rear limit switch. Such collar had been set according to the length of the loaf to be sliced. The fence in the channel is adjusted for the width of the loaf. The start button is pushed to start the feed and turn on the vacuum to the suction cup. The meat is then continuously fed into the knife at the preset rate subject to the knife speed fluctuation and the Cashin Weigh System correction. After all the meat has been pushed through, the meat hold down plate is raised and the forward limit switch is tripped, at which time the meat gripper carriage is retracted at rapid speed to its loading position where it trips the rear limit switch. At the same time the vacuum is cut off and a blast of air from the suction cup releases the butt of the loaf of meat which has just been sliced.

Thus the several aforenoted objects and advantages are most effectively attained. Although a single somewhat preferred embodiment has been disclosed and described in detail herein, it should be understood that this invention is in no sense limited thereby and its scope is to be determined by that of the appended claims.

What is claimed is:

1. In a slicing machine having a slicing blade for slicing a loaf of meat product and feeding means for pushing the said loaf to be sliced into the slicing blade the improvement for holding down the loaf of meat and preventing the rotation of such loaf comprising a. a hold down plate positioned adjacent the slicing blade and applying pressure to the top of the loaf;

b. a lifter to raise the hold down plate when the slicing operation has been completed and only the butt of the loaf remains; and c. actuator means associated with the feeding means to actuate the said lifter at the conclusion of the slicing operation whereby the hold down plate will be clear of the butt end of the loaf and permit the feeder and butt to move backward.

2. The combination of a. a slicing blade for slicing a loaf of meat product;

b. an electric knife motor for rotating the slicing blade, said motor having a device for indicating the speed of rotation;

c. a feeder for pushing the said loaf to be sliced into the slicing blade;

d. an electric feed motor for driving the feeder, said motor having a device for indicating the speed of rotation;

e. stacking and weighing apparatus at the discharge end of said slicing blade for stacking a preselected number of slices of said product as they are discharged by said slicing blade, for weighing the stacks of slices and for conveying the stacks of slices away;

f. a knife controller for controlling the rate of speed of said slicing blade and, consequently, the number of stacks per minute;

g. a pusher controller for controlling the rate of advance of said feeder toward said slicing blade and, consequently, the slice thickness and weight of a stack of preselected number of slices discharged onto the stacker and weighed;

h. a feed back coupling between the knife and pusher controllers and the speed devices on the knife and feed motors whereby variations in the knife speed are automatically introduced into the pusher controller to synchronize the rate of feed of the feeder with the speed of rotation of the slicing blade and maintain a high degree of weight accuracy; and i. a meat hold down device comprising:

1. a hold down plate positioned adjacent the slicing blade and applying pressure to the top of the loaf to hold such loaf in position and prevent rotation of the loaf;

2. a lifter to raise the hold down plate when the slicing operation has been completed and only the butt end of the loaf remains; and 3. actuation means associated with the feeding means to actuate the said lifter at the conclusion of the slicing operation;

whereby the hold down plate will be clear of the butt end of the loaf and permit the feeder and butt to move backward.

* * * * *